United States Patent [19]

Petersen

[11] 3,978,883

[45] Sept. 7, 1976

[54] DEVICE FOR REGULATING THE COMBUSTION AIR OF A FURNACE, ESPECIALLY WITH OIL- OR GASBURNER AND BLOWER FOR HEATING INSTALLATIONS

[75] Inventor: Jorgen Hartvig Petersen, Nordborg, Denmark

[73] Assignee: Danfoss A/S, Nordborg, Denmark

[22] Filed: May 2, 1975

[21] Appl. No.: 573,865

[30] Foreign Application Priority Data

May 6, 1974 Germany ..... 2421873

[52] U.S. Cl. ..... 137/489.5; 137/500

[51] Int. Cl.[2] ..... F16K 31/365; F01B 19/02; F16J 3/00

[58] Field of Search ..... 137/489, 489.5, 500, 137/502

[56] References Cited

UNITED STATES PATENTS

| | | | |
|---|---|---|---|
| 2,998,194 | 8/1961 | Curran et al. | 137/489 X |
| 3,361,157 | 1/1968 | Schach | 137/489 |
| 3,804,364 | 4/1974 | De Lepeleire | 137/489.5 X |

*Primary Examiner*—Henry T. Klinksiek

[57] ABSTRACT

The invention relates to a furnace type air throttle assembly which operates in a manner to supply a constant volume of air per unit time. This is done with a bellows and throttle arrangement in which (1) the total pressure at the inlet, which is the sum of the dynamic and static pressure, is utilized to expand the bellows and move the throttle in a closing direction and (2) static pressure and weight means are utilized to compress the bellows and move the throttle in the opening direction.

8 Claims, 5 Drawing Figures

Figure 1:
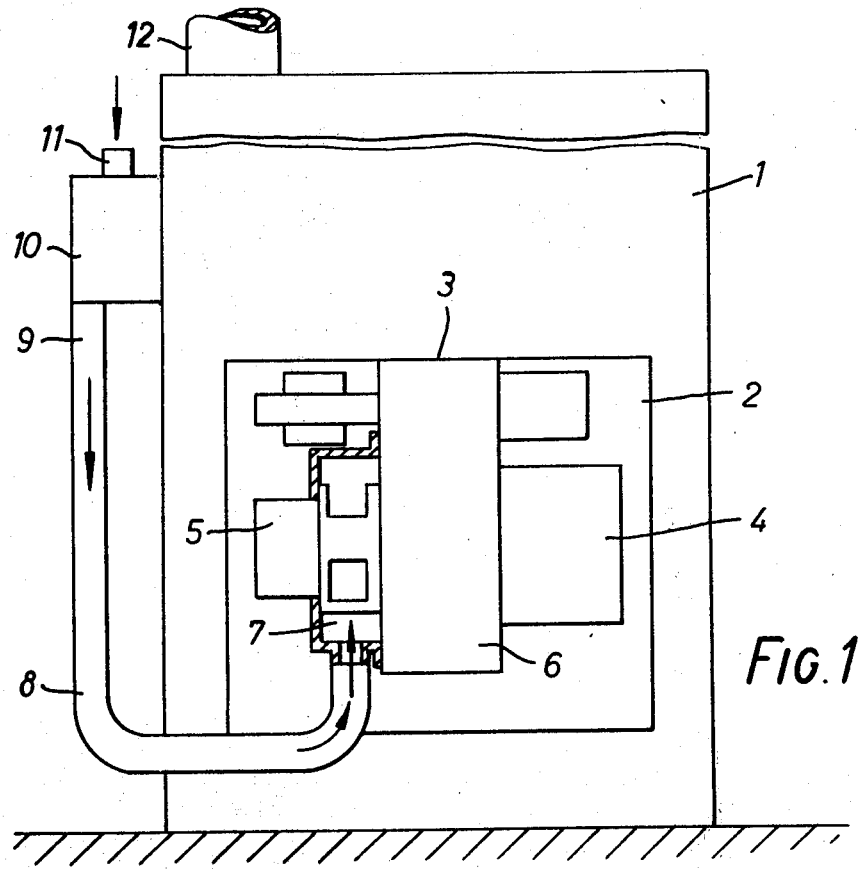

DEVICE FOR REGULATING THE COMBUSTION AIR OF A FURNACE, ESPECIALLY WITH OIL- OR GASBURNER AND BLOWER FOR HEATING INSTALLATIONS

The invention relates to a device for regulating the combustion air of a furnace, especially with oil- or gasburner and blower for heating installations, by which a throttle element by means of a regulating motor in dependance on a measured quantity is adjustable in such a way that the measured quantity is kept approximately constant.

In order to obtain the best possible combustion it is known to regulate the amount of combustion air in dependance on measurements of the $CO_2$-contents in the exhaust has. This method works slowly, is very expensive and causes trouble in that the average amount of $CO_2$ in the exhaust gas flue cross-section is only inaccurately detectable.

In a known regulation the supply of combustion air takes place in dependance on the minimum value of the exhaust gas temperature. For this purpose a temperature-dependant resistor is provided in the exhaust gas flue, which resistor is included in a bridge circuit. Over a relay the bridge circuit operates a regulating motor, which again displaces a regulating damper in the air inlet duct. Also this circuit is expensive and dull, and it does not ensure a complete combustion.

Further, a regulating motor is known, in which the gas pressure in the furnace serves as measured quantity. It is compared with the atmospheric pressure and over an electrical regulating motor it controls a relay arrangement, which regulating motor again displaces a damper in the exhaust gas flue. However, this arrangement is also expensive, dull and does not lead to a complete combustion.

In a large number of smaller furnaces, which are generally used in single family- or several stories houses, a one-through adjustment of burner and blower has till now been considered sufficient. The application of one of the known combustion air regulating means would also be too expensive.

Air ducts of conditioning plants are known, which have a plate-shaped control means, which is swingable about an axle and on the opposite end carries the throttle element, which is formed as a section of a cylinder concentrical to the axle. The control means is provided in a housing limiting the duct and connected to one housewall by means of an easily deformable bellow. The displacement takes place by means of producing two different pressures on both sides of the plate-shaped control means.

The present invention seeks to provide a device of the above mentioned sort, which in a simple way makes it possible to have a widely complete combustion, and by which variations in the measured quantity are quickly detectable.

According to the invention this is achieved in that the measured quantity first of all is dependant on the flow speed of the air.

As the cross-section of the air-leading respectively exhaust gas-leading duct in the measuring point is predetermined, the flow speed also determines the volume of combustion air supplied per time unit. As usually also the amount of combustibles per time unit to be supplied is firmly adjusted, the proportion of the amount of combustibles to the volume of combustion air can be adjusted towards a complete combustion. This proportion is then maintained during operation.

Changes in the conditions of the surroundings, especially sudden wind speed changes, immediately lead to a change in flow speed and thus to a change in measured quantity. Therefore it is possible by means of the regulation not only to detect changes in the average wind speed but also to detect the constant variations, which are superimposing the average value. These changes take place within short time, i.e. some minutes, or even within very short time, i.e. within 1o seconds. Under normal Danish meteorological conditions the short time variations lead to pressure variations in the furnace from 7 to 22 mm water column. The speed changes of the supplied combustion air, which are caused hereby, are eliminated by means of the regulation according to the invention.

By means of this regulation also the $CO_2$-contents and the soot-figure in the total operation range of the pressure of the combustion chamber can be kept practically constant and held at the requested optimal value. When using the regulation the instability figure, which indicates the volume-change of the total volume in relation to the pressure-change, is practically 0 percent, whereas it normally amounts to 1,5 to 3,5 percent. Correspondingly low is also the amount of noxious matters (unburned particles, aggressive oxides etc.) in the exhaust gas. Therefore a considerable saving of combustibles and a reduced air-polution is achieved.

Furthermore, it is advantageous that changes in the supply voltage have no influence on the blower, because a reduced supply-capacity leads to a reduction of the requested speed of the combustion air. This is compensated by means of a corresponding displacement of the throttle element.

Preferably the measuring point is in the supply duct of the combustion air. The measuring point does not have to be in the exhaust gas duct and therefore it is less exposed to soiling, which normally involves a false measuring result.

For obtaining optimal conditions it is not only a question of the volume of the combustion air, but also of its density, which decreases with the temperature. If the measuring point is in the supply duct of the combustion air and if the density variations, which are dependant on the temperature, are low, this does not play an important part. In order to obtain higher accuracy the measured quantity can furthermore be dependant on the density of the combustion air.

In a preferred embodiment the dynamic pressure of the flow is included in the measured quantity. The dynamic pressure is proportional to the square of the speed and besides to the density of the combustion air.

Such a measured quantity is obtained if it is equal to the pressure difference between the total pressure of the flow and a reference pressure. If the reference pressure is a static pressure measured approximately in the same place as the total pressure the measured quantity will correspond to the dynamic pressure.

It is also possible to chose another approximately constant reference pressure, for instance if in operation the measured quantity must have a certain minimum value. This can be obtained in that the cross-section of the duct is divided into two sections by means of a dividing wall, one section showing a cross-section-reduction and afterwards a cross-section-enlargement, and a static pressure is derived from the place having the smallest cross-section. This static pressure is relatively low as the initial value must be divided by the speed.

In a further embodiment of the invention not only the measured quantity but also the throttle element is placed in the supply duct of the combustion air. In this way also soiling of the throttle element is practically avoided. Due to the proximity of measuring point and throttle element also the reaction rate can be increased.

Furthermore, the regulating motor can be actuated by means of a pressure-medium and the supply duct of the combustion air can serve as pressure-medium-source. Thus the regulating motor does not need a further energy-supply.

A further simplification is obtained if the measured quantity is a pressure signal acting directly on the pressure-medium actuated regulating motor.

Especially the regulating motor can have a plate-shaped actuator means, which on one side is influenced by the total pressure of the flow and on the other side by the reference pressure. Thus the regulating motor is actuated by means of the difference of these pressures corresponding to the measured quantity.

In a preferred embodiment the plate shaped actuator means is swingable about an axle and firmly connected to the throttle element, which is formed as a section of a cylinder concentrical to the axle and the actuator means is placed in a housing partly limiting the duct, whereby an easily deformable bellow is placed between the actuator means and one housewall.

Such a regulating motor almost instantaniously follows changes in the pressure signals of the measured quantity. As also the throttle element is directly connected to the actuator means a regulating device is achieved, which almost without delay follows the changes in speed of the combustion air. Therefore also very short-timed changes in the wind speed may be allowed for.

It is advantageous that the cross-section of the duct in the range of the measuring point is adjustable by means of a second throttle element. By means of changing the second throttle element a different volume of combustion air is achieved, as the first throttle element keeps the speed in the measuring point approximately constant. Another possibility is to change the regulating motor, for instance to load its pressure-loaded actuataor means with a changeable weight.

Further, the second throttle element can be displaced in dependance on the amount of combustibles supplied per time unit. This is advantageous where the amount of combustibles changes continuously in dependance on the need or where for instance the oil- or gas-supply follows in two steps of different outputs. By displacing the second throttle element the volume of combustibles is adjusted to the amount of combustibles.

Instead of this, the second throttle element can be displaceable in dependance on the temperature of the combustion air. This measure is recommendable especially where it is a question of accuracy, for instance in blue-flame-burners and evaporizing burners.

In a preferred embodiment a preferably detachable filter is mounted in the air entrance. This filter holds back particles which would otherwise be brought along by the wind. Thus soiling of blower and burner by these particles is avoided. On the other hand the flow resistance of the filter will gradually be increased. However, this is not important as the increased resistance is eliminated by means of a corresponding displacement of the throttle element of the regulating device.

Furthermore, throttle element, regulating motor, measuring point and filter may be combined into a constructional unit, which is connected ahead of the blower. This arrangement can also be built into existing burners, for instance in that the intake of the blower over a flexible tube is connected to the building block.

Instead of this, throttle element, regulating motor, and measuring point can be placed between blower and burner. This leads to a compact arrangement, which can be mounted immediately at the door of the combustion chamber. The mentioned parts can also be situated in the suction chamber of the blower.

In a further embodiment of the invention an electrical indicationor control circuit can be provided with a contact, which can be actuated when a predetermined end position of the throttle element is achieved. If for instance in operation the throttle element must open completely, this may indicate a defect component of the arrangement. For instance may the filter be so dirty that it has to be cleaned.

The throttle element can be influenced by a force, which in case of the flow speed falling below a limiting value displaces the throttle element into a rest-position, in which it essentially completely releases the cross-section of the duct. This means that the combustion chamber is completely ventilated in the rest-periods so that it is possible to achieve a soot-free starting as well as a soot-free switching off, even if the oil-supply does not follow instantly.

Contrary to this the duct can be completely closed by means of switching off the burner. Thus it is prevented that the combustion chamber and the chimney are cooled by air flowing through continuously. Correspondingly the exploitation of the combustibles is increased.

This may be achieved in that the throttle element is influenced by a force, which in case of the flow speed falling below a limiting value displaces the throttle element into a rest-position, in which it essentially closes the cross-section of the channel, and under the influence of the flow acting upon it is adjustable against the mentioned force into an on-position.

Another possibility is that a further throttle element is connected in series with the throttle element opening the cross-section of the duct in the rest-position, which further throttle element in the rest-position closes the cross-section of the duct and releases it when influenced by the flow. The further throttle element can be a simple non-return damper. Hereby it does not cause any damage if various on-positions occur in dependance on the pressure, because a pressure-drop effected hereby will be eliminated by means of the pressure-dependant first throttle element.

It is especially advantageous if the further throttle element is mounted on a plate, which is swingable about an axle and provided with a counter-weight, which plate when using an easily deformable bellow on one side is capable of bearing a reference pressure and on the other side the total pressure in the air duct and which is swingable against an adjustable bearing. In the on-position the further throttle element takes a position which is predetermined by a displaceable baring. Consequently it may be used as second throttle element for determination of the cross-section of the duct in the area of the measuring point.

The invention will now be described by reference to forms of construction illustrated in detail in the drawing, in which FIG. 1 shows the application of a regulating device according to the invention in an existing burner for a heating furnace, FIG. 2 a schematic longitudinal section of a regulating device according to the invention, FIG. 3 a schematic longitudinal section of a regulating device combined with the blower, FIG. 4 a schematic longitudinal section of a further embodiment of the invention, and FIG. 5 a schematic longitudinal section of a third embodiment of the invention.

In FIG. 1 a furnace 1 is shown having a door 2 provided with burner unit 3, consisting of a motor 4, an oilpump 5 and a blower 6 with a suction chamber 7 connected ahead of it. The suction chamber is via a flexible tube 8 connected to the outlet nozzle of a combustible air-regulating device 1o, showing an inlet-nozzle 11. Via a pipe 12 the exhaust gas is lead to the chimney. The control circuit related to the burner unit with flame-controls etc. is only shown schematically.

Figure 2:
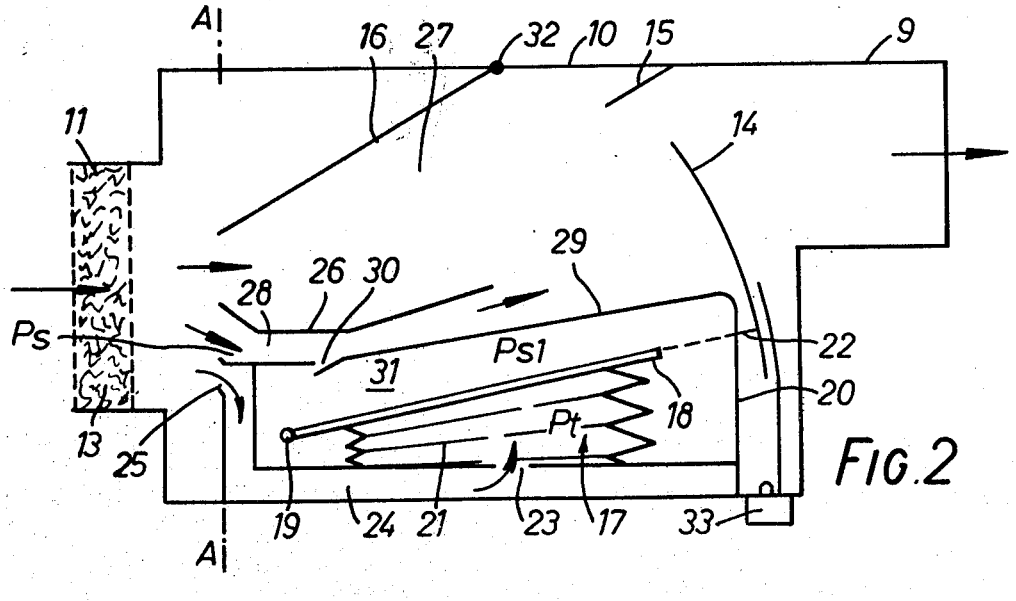

In FIG. 2 a schematic longitudinal section of the regulating device 1o is shown. Here it works with horizontal air passage, however, it may also as shown in FIG. 1 be passed through from above and downwards, whereby a further force (weight, spring) affects the displaceable parts.

In the suction branch 11 a filter 13 is mounted, which is detachable for cleaning purposes. In the regulating device 1o a first throttle element 14, working together with a frame 15, and a second throttle element 16 is mounted, which determine the effective cross-section of the channel in the plane A—A.

The throttle element 14 is displaced by means of a working motor 17, showing a plate-shaped actuator means 18, which is swingable about an axle and placed in a housing 2o. Between the plate-shaped actuator means 18 and one housewall an easily deformable bellow 21 is placed, which consists of individual thin pockets, which are stuck together and each of which is connected over an opening. Besides the housing 2o an arm 22 is placed on the axle. The arms carry on their free ends the throttle element 14, which is formed as a section of a cylinder concentrical to the axle 19. This involves that pressions on the throttle element 14 do not exert any torque on the actuator means 18.

Via an opening 23 and a channel 24 the inner of the bellow 21 is connected to an opening 25 facing the inlet branch 11. Therefore the total pressure $p_t$ of the combustion air flowing in is prevailing in the bellow 21. The effective cross-section of the channel is divided into two sections 27 and 28 by means of a dividing wall 26. The section 28 undergoes a cross-section reduction and afterwards a cross-section enlargement. In the area of the smallest cross-section an opening 3o is provided in the upper wall 29 of the housing 2o, which opening is connected to the interior space 31 of the housing 2o. In this space therefore a static pressure $p_s1$ is prevailing, which is so much smaller than the static pressure $p_s$ in the plane A—A as corresponding to the relation between the speeds.

The throttle element 16 is swingable about an axle 32 in such a way that the free cross-section of the channel in the plane A—A may be chosen arbitrarily. When starting, the throttle element 16 is placed in a position corresponding to the requested volume of air. However, it may also in operation be controlled in depenance on the amount of combustibles or any other characteristic quantity.

As is well known the total pressure $p_t$ is constituted by the total of the dynamic pressure $p_d$ and the statis pressure $p_s$. Hereby the static pressure $p_s$ is practically constant, whereas the dynamic pressure corresponds to the formula $$p_d = K \cdot \tfrac{1}{2} \cdot \rho \cdot C^2,$$

$K$ being a constant, $\rho$ the density of the combustion air and C the air flow speed. The total pressure $p_t$ in the inner of the bellow 21 is thus constituted by a constant value and a value which is proportional to the density and the square of the speed. From above the almost constant reduced static pressure $p_s1$ and a weight are acting upon the actuator means. The weight originates from the actuator means 31, the arms 22 and the throttle element 14. This weight may be increased by means of a further weight, decreased or compensated by means of counter-weights mounted on both sides of the axle 19. The actuator means 18 and the throttle element 14 adjust themselves in a neutral position, in which the counteracting pressures or weights are in balance. If, according to an increase of the chimney draft because of a change in the wind speed, combustion air-speed increases, the total pressure $p_t$ will increase correspondingly. This leads to an anticlockwise motion of the throttle element 14 and practically immediately this means a further throttling. Because of this the air flow rate is throttled in such a way that the volume of air remains constant in spite of the higher driving power. The same applies if the draft caused by the wind is decreased or the filter 11 or the other air ducts of the burner because of a partly soiling adopt a higher flow resistance.

If the blower is turned off, the speed of the air and thus also the total pressure $p_t$ fall below a predetermined value. Influenced by its weight the actuator means 18 sinks downwards so that the throttle element 14 completely releases the cross-section of the channel. If the throttle element 14 reaches the completely open position it actuates a contact 33, which during normal operation actuates an electric circuit indictating some mistake, for instance that the filter 11 is dirty.

It does not require any further explanation that the device functions in a similar way if it is mounted vertically so that the air passes through from above and downwards. In this case the total pressure $p_t$ presses the actuator means 18 to the right, whereas the reduced static pressure $p_s1$ presses to the left. In the same way a weight may serve as restoring force.

Figure 3:
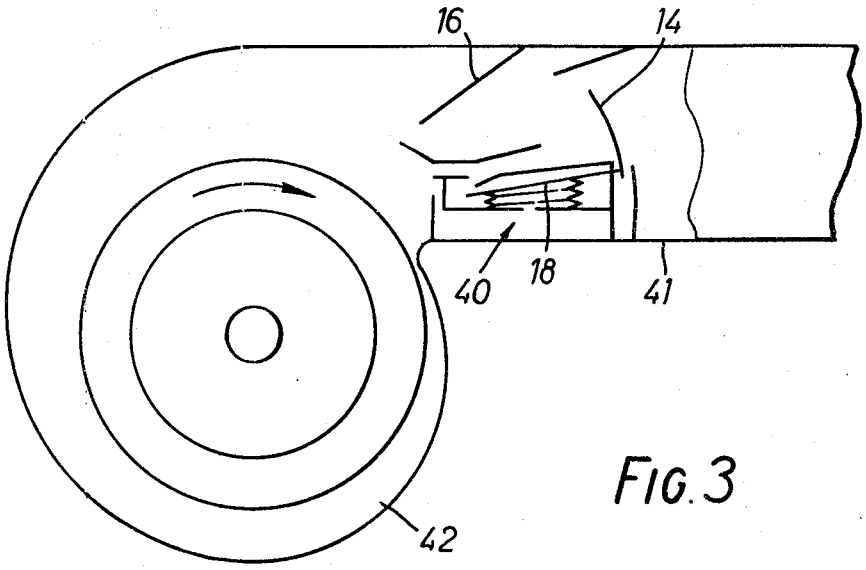

In FIG. 3 it is shown how a device 4o corresponding to the regulating device 1o is built into the pressure joint 41 of a blower 42. This function corresponds to the one shown in FIG. 2, apart from the fact that the pressures $p_t$, $p_s$ and $p_s1$ are on a higher level. The regulating device in this way forms a constructional unit together with the blower and the further burner, which constructional unit is easy to mount.

Figure 4:
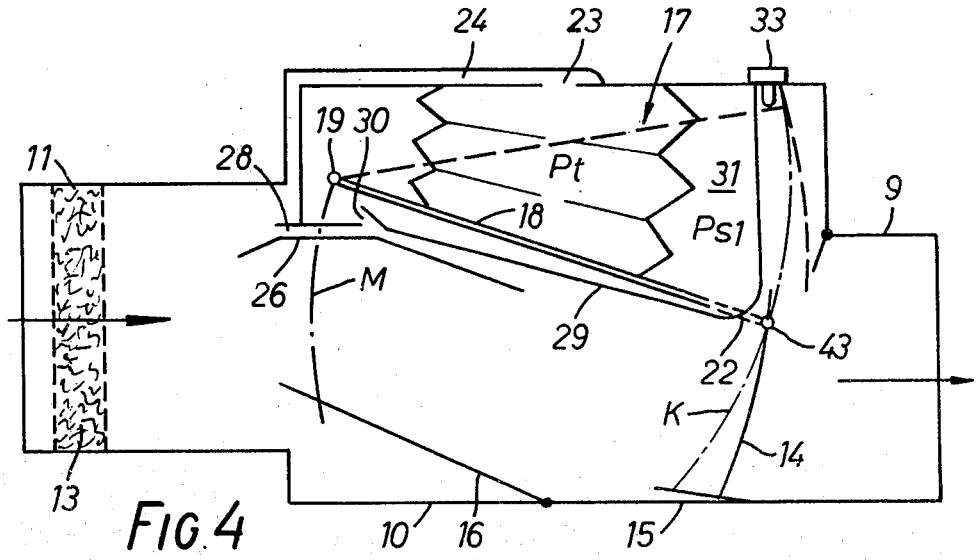

While in FIG. 2 the weight of the throttle element 14 and the parts connected herewith by means of its own weight in the rest-position comes into a position, in which the cross-section of the channel is completely open, the own weight of the throttle element 14 and the parts connected herewith in FIG. 4 involves a complete closing of the channel cross-section in the rest-position. In this construction a plate-shaped actuator means 18 is provided, which is firmly connected to an axle 19, which carries arms 22, on which in the point 43 the throttle element 114 is mounted. The point 43 moves on a circular track K about the axle 19. While in FIG. 2 the throttle element 14 is adjusted exactly to this circular track, the throttle element has in the construction according to FIG. 4 a position displaced in relation to this, as it is shown by a full line in the rest-position and a broken line in the working position. The imagined center point of the cylinder, of which the throttle element 114 has been cut out, therefore during the adjusting movement moves on a second circular track M. Because of this the pressure on the throttle element by the flow is not completely absorbed by the axle 19; on the contrary remains a component of force which exerts a turning moment on the throttle element 114 and the parts moved with it.

In the resting position the throttle element 114 has the shown position, in which the air duct is completely closed. If the blower is turned on, the arizing flow is exerting such a pressure on the throttle element 114 that this is swinged into the upper position shown by means of a broken line. On the actuator means 18, as in the previous examples, a control pressure corresponding to the dynamic pressure works, which tries to swing the actuator means 18 downwards. The counter-weight keeping the device in balance is produced by the flow exerted on the throttle element 114 minus the weight. As a result of this the throttle element 114 reaches a position, which corresponds to the flow rate.

Figure 5:
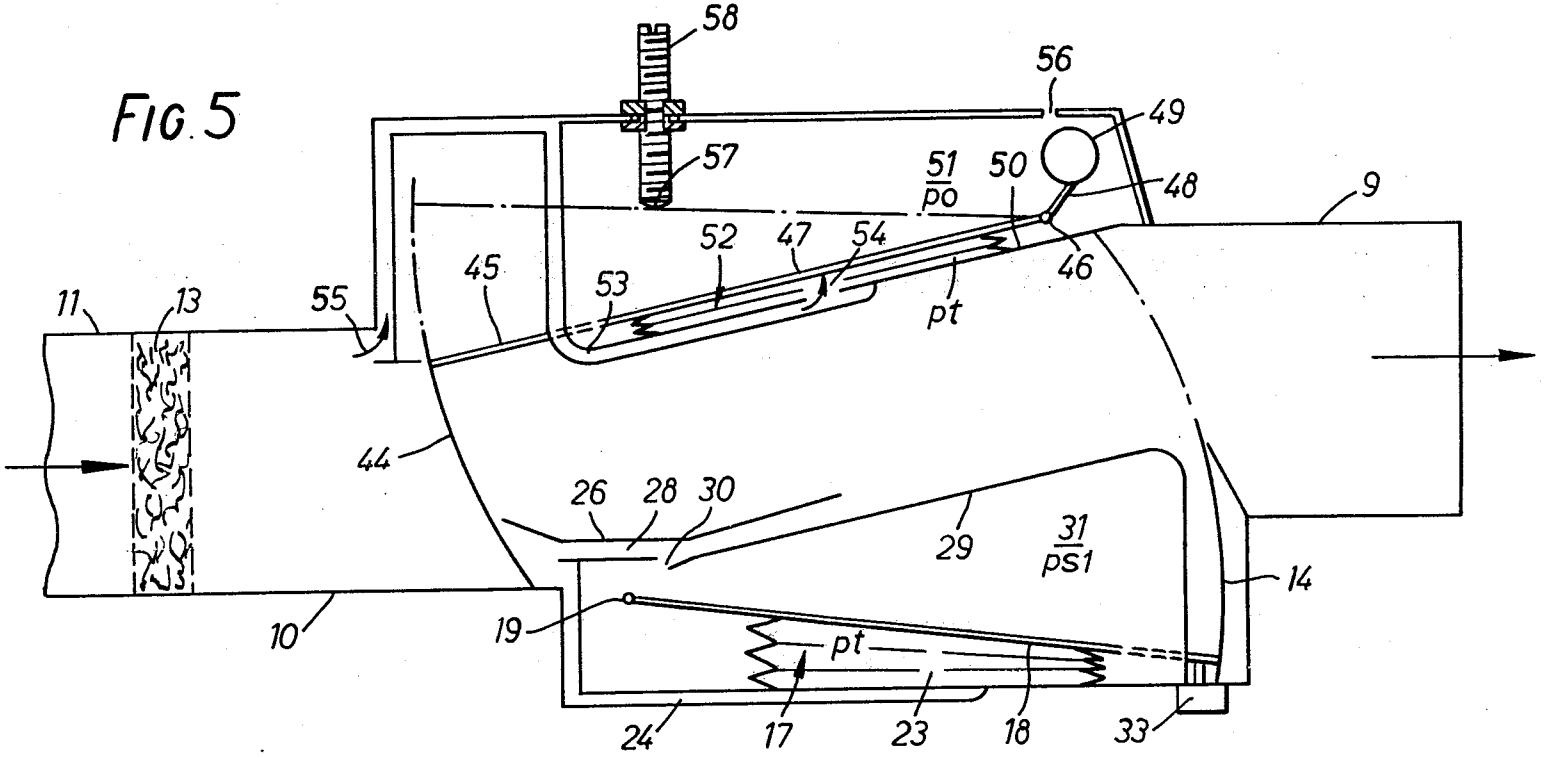

In the construction according to FIG. 5 the throttle element 14 is part of a device corresponding to FIG. 2. In series herewith a further throttle element 44 is connected, which is placed on arms 45, which are firmly connected to an axle 46, on which also a plate-shaped actuator means 47 is mounted. Furthermore, a counter weight is placed over an arm 48. Between the actuator means 47 and the wall 5o of a chamber 51 an easily deformable bellow 52 is placed, the inner chamber of which via a channel 53 and the outlet opening 54 of an opening 55 is supplied with the total pressure $p_t$. The chamber 51 is via an inlet 56 connected with the atmospheric pressure $p_o$. Furthermore, an adjustable bearing 57 is provided for the actuator means 47. This bearing is formed on a screw 58, which clampably is lead through the upper house wall. This device is preferably provided between the blower and the burner.

In the rest-position the combustible supply channel is completely closed by the throttle element 44. As soon as the blower starts working, the throttle element 44 by means of the total pressure $p_s$ is lifted up into the chain-dotted position, which is predetermined by the bearing 57. The lower end of the throttle element 44 then has a defined position, corresponding to the throttle element 16 in FIGS. 2 and 4. By displacing the screw 58 adjustments to the requested amount of air can take place. When the throttle element 44 has reached the upper position, what is made easier by means of the counter-weight 49, the throttle element 14 works in such a way as described in connection with FIG. 2.

I claim:

1. A furnace type air throttle assembly having automatic volume control comprising, a conduit having entrance and outlet ends, a chimney at said outlet end of said conduit, blower and oil burner units at said outlet end of said conduit upstream from said chimney, a bellows in said conduit at said entrance end, said bellows having an attached end and a free end, plate means attached to said free end, a housing in said conduit surrounding said bellows, pivot means in said housing, said plate means being attached to said pivot means, carrier arms attached to said pivot means exteriorly of said housing, a movable throttle element attached to said carrier arms, a wall dividing said conduit to form first and second channels with said first channel being adjacent said housing, passage means from said inlet end to the interior of said bellows for communicating thereto the total pressure from said inlet end, said first passage having a cross section reduction followed by a cross section enlargement, and an opening in said housing in the region between said reduction and enlargement for communicating the static pressure of said region to the interior of said housing.

2. A throttle assembly according to claim 1 wherein said throttle element is a cylindrically shaped section with its axis being coincident with said pivot means.

3. A throttle assembly according to claim 1 including a second throttle element which determines the cross section of said inlet end of said conduit.

4. A throttle assembly according to claim 1 wherein said movable throttle element moves by gravity to a fully open position in the absence of a stream of air flowing through said conduit.

5. A throttle assembly according to claim 1 wherein said movable throttle element moves by gravity to a fully closed position in the absence of a stream of air flowing through said conduit.

6. A throttle assembly according to claim 5 wherein said throttle element is a cylindrically shaped section with its axis being offset from said pivot means.

7. A throttle assembly according to claim 1 including a longitidinally extending partition in said conduit, a second bellows in said conduit having an end attached to said partition and a free end, second plate means attached to said free end of said second bellows, second pivot means in said conduit, said second plate means being attached to said second pivot means, second carrier arms attached to said second pivot means exteriorly of said housing, second movable throttle element attached to said second carrier arms, second passage means from said inlet end to the interior of said second bellows for communicating thereto the total pressure from said inlet end, said second movable throttle element being movable by gravity to a closed position in the absence of a stream of air flowing through said conduit.

8. A throttle assembly according to claim 7 including a counterweight attached to said second plate means for biasing said second throttle element in an opening direction.

* * * * *